US005390999A

United States Patent [19]

Fuller

[11] Patent Number: 5,390,999

[45] Date of Patent: Feb. 21, 1995

[54] FOLDING BENCH

[76] Inventor: A. Clayton E. Fuller, 2 Pine Tree Dr., Buzzards Bay, Mass. 02532

[21] Appl. No.: 995,036

[22] Filed: Dec. 22, 1992

[51] Int. Cl.[6] ..... A47B 83/00

[52] U.S. Cl. ..... 312/235.5; 312/351.9; 312/258; 297/54; 297/377

[58] Field of Search ..... 312/231, 235.2, 235.4, 312/235.5, 244, 258, 351.9; 297/54, 188, 193, 377; 108/25, 127, 131

[56] References Cited

U.S. PATENT DOCUMENTS

| | | | |
|---|---|---|---|
| 1,185,181 | 5/1916 | Collins | 297/377 X |
| 1,329,261 | 1/1920 | Celane | 297/54 |
| 1,398,253 | 11/1921 | Blando | 297/377 X |
| 1,426,140 | 8/1922 | Anselm | 297/54 |
| 1,612,036 | 12/1926 | Lovik | 297/377 X |
| 2,047,178 | 7/1936 | De Coninck | 297/377 X |
| 4,076,348 | 2/1978 | Allison | 312/231 |
| 4,149,763 | 4/1979 | Delahaie | 312/231 |

OTHER PUBLICATIONS

P. 59, Artist's Horse, Creative Enterprises, advertisement.

American Artist magazine, p. 102, The Easel, DeLong Services Co., Inc., advertisement.

American Artist magazine, p. 60, Combination 12×16 Art Box Easel, Tom Ford, advertisement.

American Artist, p. 7, Dec. 1974, Porta-Painter, Porta Industries, advertisement.

*Primary Examiner*—Brian K. Green

*Attorney, Agent, or Firm*—Fish & Richardson

[57] ABSTRACT

A folding bench has a first surface and first surface support girders. First and second support members are selectively positionable in an extended position, generally perpendicular to the first surface, and in retracted position, generally parallel and adjacent to the first surface. A second surface is selectively positionable in an extended position and in a retracted position. The second surface is connected to the first surface with a first mechanism and connected to the first support member with a second mechanism. A third mechanism is arranged to stabilize the support members in the first extended position and allows the support members to assume the second retracted position. A fourth mechanism secures the first and second support members in the second retracted position.

18 Claims, 4 Drawing Sheets

FIG. 4
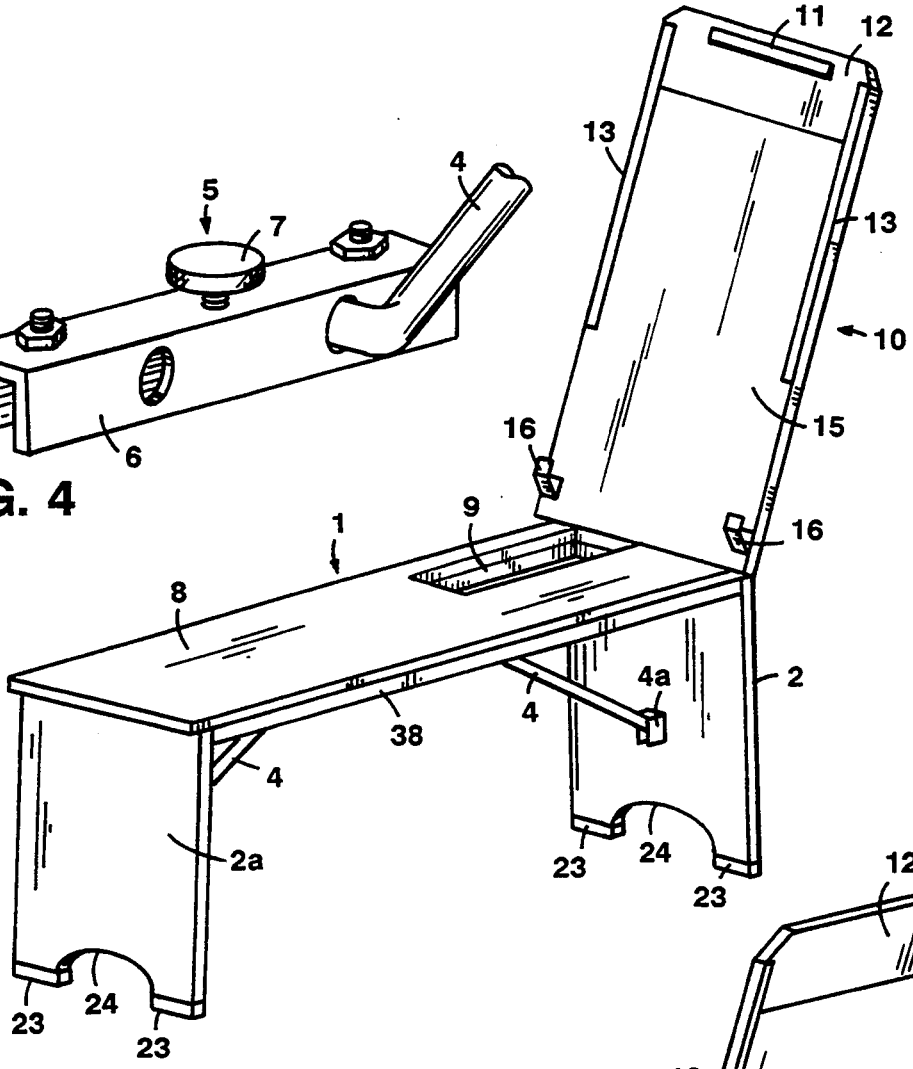
FIG. 1
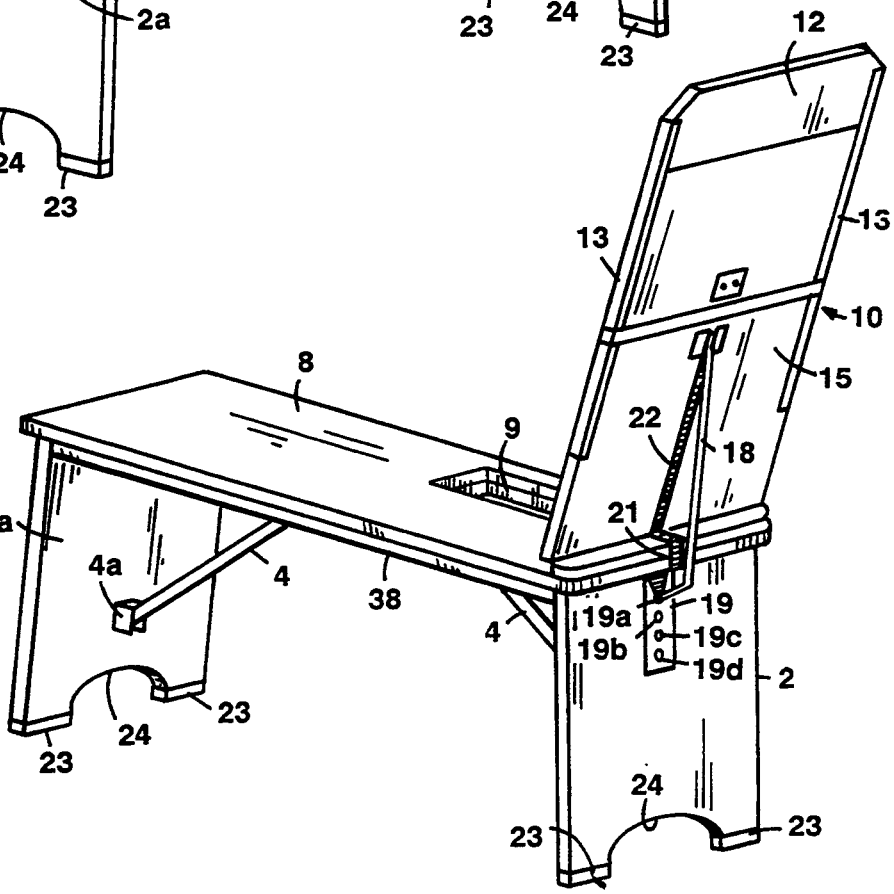
FIG. 7

FOLDING BENCH

This invention relates to a folding bench.

BRIEF SUMMARY OF THE INVENTION

According to one aspect of the invention, a folding bench comprises a first surface having first surface support girders, first and second support members selectively positionable in a first extended position generally perpendicular to the first surface and in a second retracted position generally parallel and adjacent to the first surface. A second surface is selectively positionable in a first extended position forming a generally obtuse angle relative to the first surface and in a second retracted position generally parallel and adjacent to the first surface. The second surface is connected to the first surface with a first mechanism and connected to the first support member with a second mechanism. A third mechanism is arranged to stabilize the support members in the first extended position and allows the support members to assume the second retracted position. A fourth mechanism secures first and second support members in the second retracted position.

According to another aspect of the invention, the third mechanism comprises a knurled screw, a cam, securing screws, support member stabilizing rods pivotally connected to the support members and a channel member formed with openings accommodating the support member stabilizing rods.

According to another aspect of the invention, the fourth mechanism comprises first and second hooks attached to the first and second support members, respectively, a locking unit attached to one of said first surface support girders with first and second screws having first and second springs, respectively, therebetween.

Other features, objectives, and advantages of the invention will become apparent from the following description when read in connection with the accompanying drawings in which:

BRIEF DESCRIPTION OF THE SEVERAL VIEWS OF THE DRAWING

FIG. 1 is a front perspective view of a folding bench according to the invention with the folding board and legs in the extended position;

FIG. 4 is an enlarged perspective view of the lock mechanism of FIG. 3;

FIG. 7 is a rear perspective view of the folding bench of FIG. 1;

DETAILED DESCRIPTION

Figure 3:
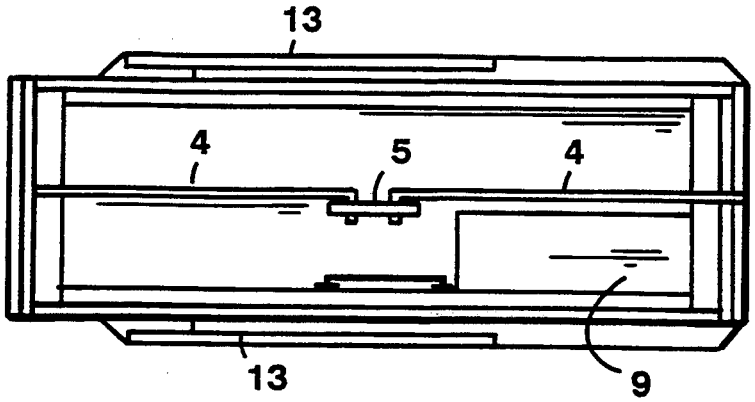
FIG. 3 is a bottom view of the folding bench with the legs in the extended position showing an exemplary lock mechanism.
Figure 2:
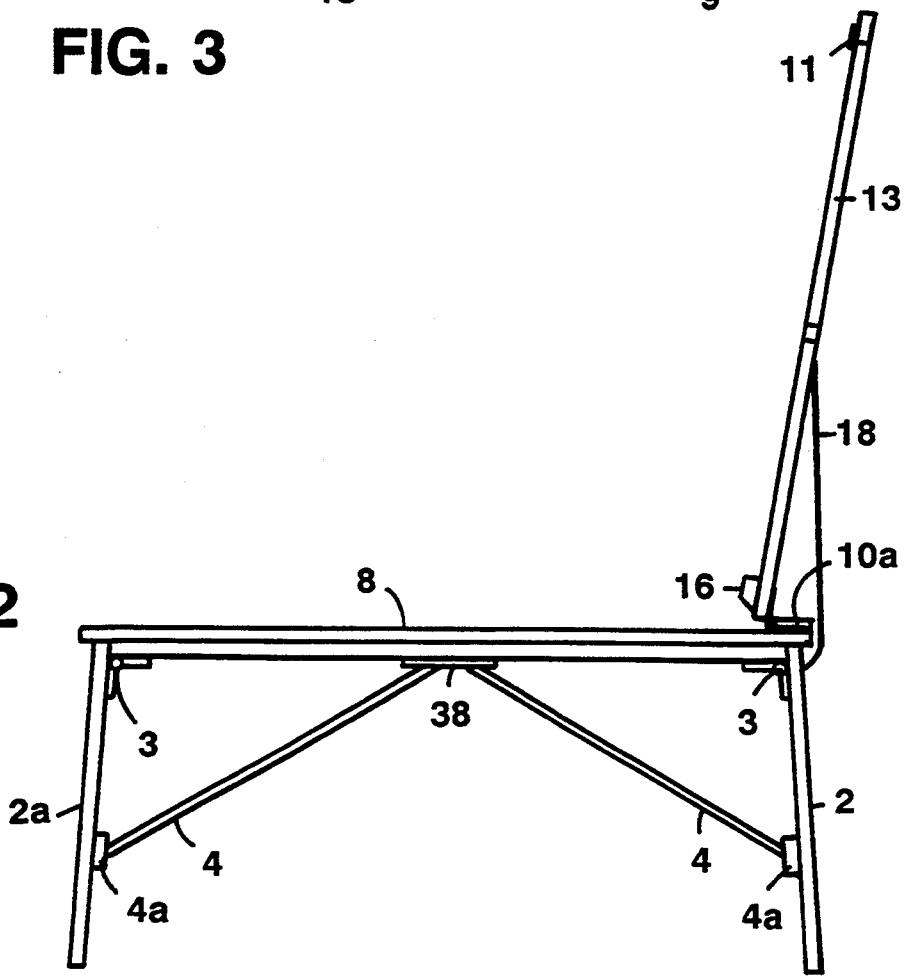
FIG. 2 is a right side elevation view of the folding bench of FIG. 1.

With reference now to the drawings and more particularly FIG. 1, there is shown a front perspective view of a folding bench according to the invention. Folding bench 1 is constructed of lightweight wood (e.g., birch or similar plywood); reinforced wooden girders (e.g., oak or similar wood); fittings made of steel and aluminum; and plastic material (e.g., Delrin polyoxymethylene). The wood is protected by a durable all-weather finish.

Referring to FIGS. 2–4*a*, there are shown side elevation, bottom, enlarged perspective lock mechanism and partial lock mechanism sectional side views of the embodiment of FIG. 1. Legs 2 and 2*a* are swung on solid steel hinges 3 and are stabilized by steel stabilizing rods 4 retained in position by fang-lock mechanism 5 having ends of stabilizing rods 4 resembling fangs passing through channel receptacle 6. Fang-lock mechanism 5 is activated by turning knurled screw 7 about one turn and drawing up wedge 8A functioning as a cam to lock steel rods 4 into place. Steel rods 4 are pivotally connected to legs 2 and 2*a* with hinges 4*a*. This arrangement imparts little stress on retaining fang-lock mechanism 5 when legs 2 and 2*a* are in an extended position.

Figure 5:
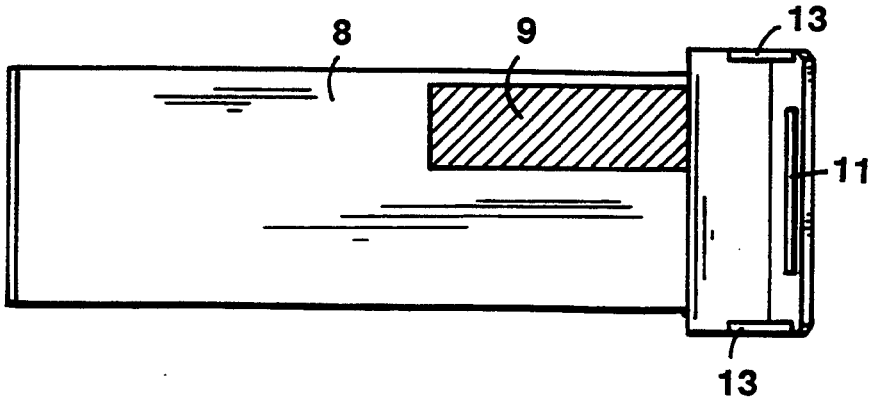
FIG. 5 is a top view of the folding bench of FIG. 1.
Figure 4A:
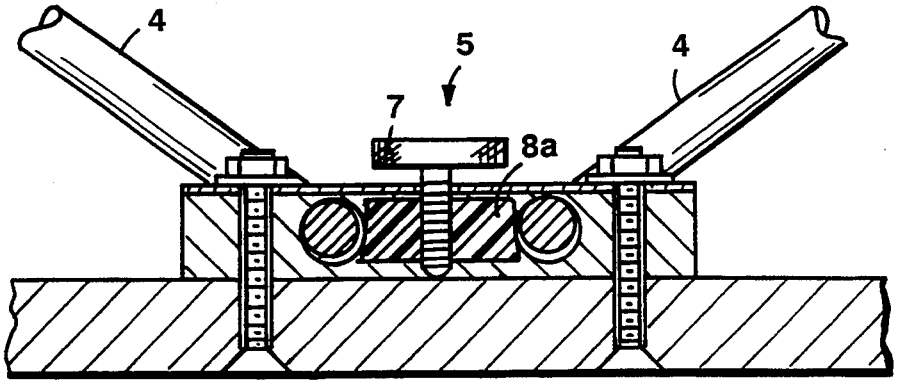
FIG. 4*a* is an enlarged partial sectional side view of the lock mechanism of FIG. 3.
Figure 11:
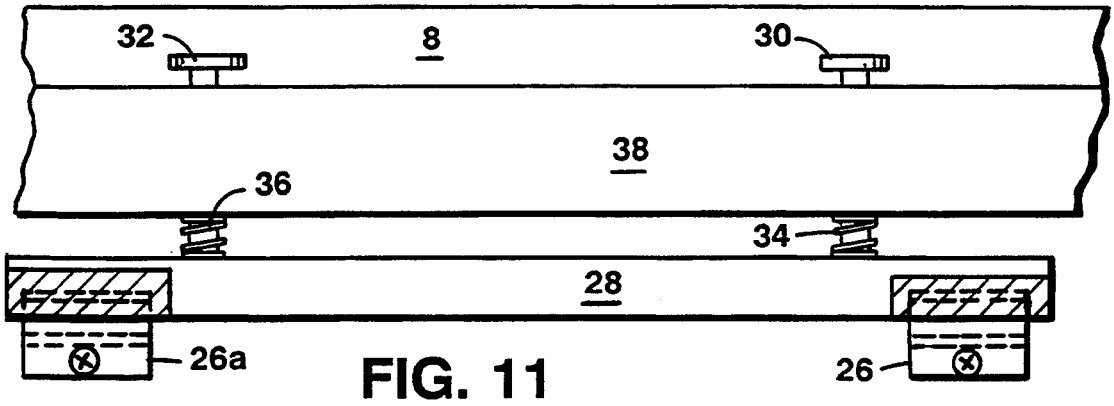
FIG. 11 is an enlarged side view of the leg lock mechanism of FIG. 10.
Figure 12:
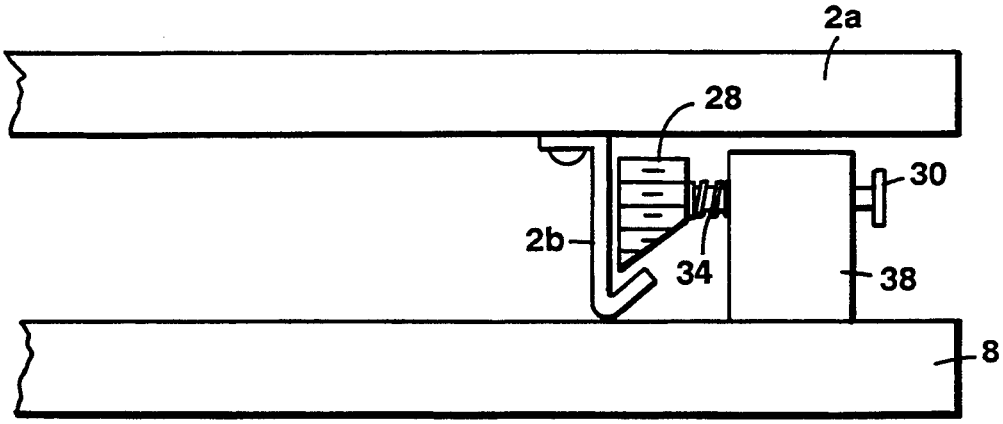
FIG. 12 is an enlarged end view of the leg lock mechanism of FIG. 11.
Figure 6:
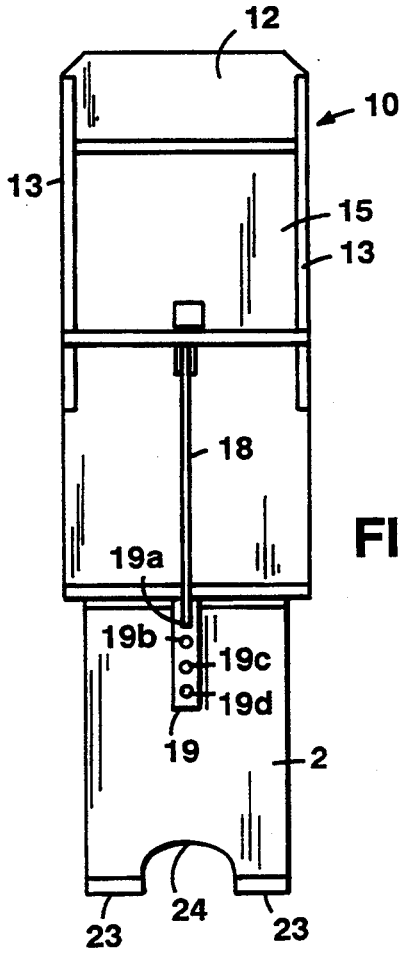
FIG. 6 is a front elevation view of the folding bench of FIG. 1.
Figure 9:
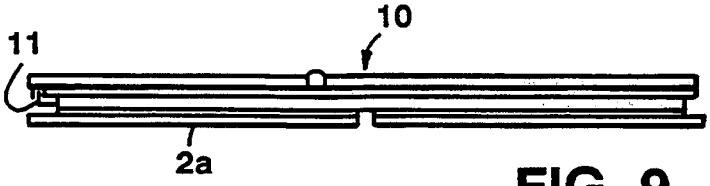
FIG. 9 is a right side elevation view of the folding bench with the folding board and legs in retracted position.
Figure 10:
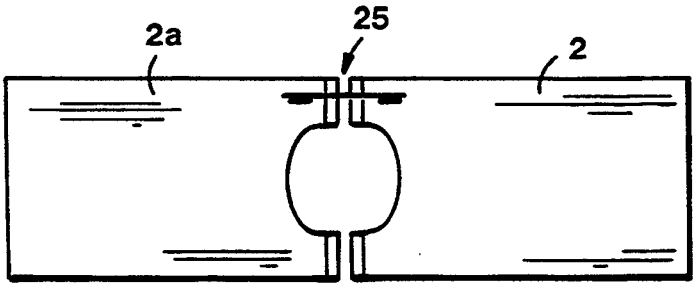
FIG. 10 is a view of the top side of the retracted support legs showing an exemplary leg lock mechanism.
Figure 8:
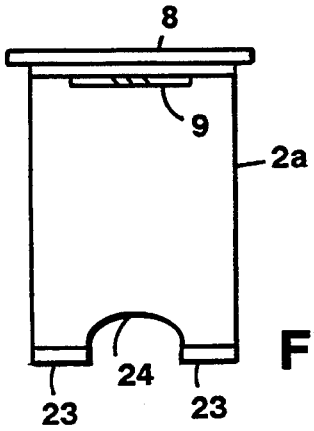
FIG. 8 is a rear elevation view of the folding bench of FIG. 1 with the folding board in the retracted position.

Referring to FIGS. 5–7, there are shown top, front elevation and rear perspective views of the embodiment of FIG. 1. Bench seat 8 having support girders 38 has a recessed storage bin 9 either longitudinally or transversely arranged to hold work materials (e.g., drawing or painting materials) in an accessible position in front of the user.

Folding board 10 has steel clip 11 that can hold a variety of work surfaces (e.g., drawing or painting surfaces such as single sheets, very small tablets, large pads, and also stretched canvases). Folding board 10 is made in two parts; upper folding board section 12 and lower folding board section 15. Upper folding board section 12 is movable up and down on side channels 13. Side channels 13 also stabilize wide work surfaces. When upper folding board section 12 is removed, T-square 14 (not shown) can be used on the edges of lower folding board section 15 both horizontally and vertically. Lower folding board section 15 has two brackets 16 to hold bottom rail 17 (not shown) of work surfaces (see FIGS. 1 and 2). That is to say, brackets 16 at each lower corner function as holding devices for work surfaces.

The angle of folding board 10 is adjustable on hinge 10*a* (See FIG. 2) by adjusting steel rod 18, which is inserted in receptacle 19 located on leg 2. There are four holes, 19*a*–19*d*, in receptacle 19 so that folding board 10 can be adjusted from near vertical to almost horizontal positions; positions used commonly for a variety of working techniques. Steel rod 18 automatically enters hole 19*a* when folding board 10 is extended. Steel rod 18 folds automatically into groove 21 in bench seat 8, and retainer 22, a groove formed in lower folding board section 15, folds in folding board 10 when folding board 10 is lowered to receive steel rod 18, thereby reducing the thickness of folding bench 1. There are no retaining rods or braces on the user's side of folding board 10 that would interfere with placing materials on the working surface.

The bottoms of legs 2 and 2a have aluminum channel caps 23 to protect the wood. The lower ends of legs 2 and 2a are formed with cutouts 24 separating foot portions of the legs covered by aluminum channel caps 23 to provide a convenient grip for carrying folding bench 1 in the vertical line of the user's body, so that it can be easily transported, even in elevators, public transportation vehicles, or revolving doors. Folding bench 1 has some limited longitudinal flexibility so that it will adjust to moderately uneven surfaces.

Referring to FIGS. 8–12, there are shown rear elevation, side elevation and top views of the invention in retracted position and enlarged side and end views of the leg lock mechanism. When folding bench 1 is folded, folding board 10 covers bin 9 so that the contents are secure when the unit is carried. When folding bench 1 is folded, folding board 10 locks down by closing steel clip 11 over the end of bench seat 8.

Legs 2 and 2a are secured in the folding position by leg lock mechanism 25. Leg lock mechanism 25 includes hooks 26 and 26a, e.g., made of aluminum, secured on legs 2 and 2a, respectively, and lock unit 28, having a trapezoidal cross section, secured to bench seat 8 on girders 38 with screws 30, 32 having springs 34, 36, respectively, therebetween. Legs 2 and 2a are secured in a retracted position when springs 34 and 36 return locking unit 28 to position so that hooks 26 and 26A engage locking unit 28 (see FIG. 12).

The invention is lightweight, strong, stable, versatile, convenient to use, and easy to set up and fold. Thirty-six units of a specific embodiment weighing about 12 pounds may be stored in a single cubic yard of space. When folded, a specific embodiment measures approximately 33"×12"×3". The time for set up is typically less than 30 seconds; and to fold and secure, about 15 seconds.

Other embodiments are within the claims.

What is claimed is:

1. A folding bench comprising:

a first surface having first surface support girders;

first and second support members selectively positionable in a first extended support position generally perpendicular to said first surface and in a second retracted support position generally parallel and adjacent to said first surface;

a second surface selectively positionable in a first extended surface position forming a generally obtuse angle relative to said first surface and in a second retracted surface position generally parallel and adjacent to said first surface;

said second surface connected to said first surface with a first mechanism and connected to said first support member with a second mechanism; and a third mechanism arranged to stabilize said support members in said first extended support position and allow said support members to assume said second retracted support position, wherein said third mechanism comprises support member stabilizing rods pivotally connected to said support members and having rod ends resembling fangs, and a channel member attached to said first surface and formed with openings accommodating said rod ends.

2. The folding bench of claim 1 where said first mechanism comprises a hinge allowing said second surface to pivot 180° with respect to said first surface.

3. The folding bench of claim 1 where said second mechanism comprises a second surface support rod pivotally attached to one of said second surface and said first support member, and wherein the other of said second surface and said first support member has a receptacle, said rod being inserted into said receptacle.

4. The folding bench of claim 3 where said receptacle is constructed to define a plurality of positions into which said second surface support rod can be inserted.

5. The folding bench of claim 3 where said first surface and said second surface have grooves to accommodate said second surface support rod when said second surface is in said retracted position.

6. The folding bench of claim 1 where said first surface and said second surface are characterized by length and width and the length and width of said second surface are of the order of the length and width respectively of said first surface.

7. The folding bench of claim 1 where said first surface and said support members are characterized by length and width and the length of said support members is of the order of one half the length of said first surface and the width of said support members is substantially equal to the width of said first surface.

8. The folding bench of claim 1 where said second surface is formed of upper and lower sections constructed and arranged so that said upper section is removable from and slidably attached to said lower section.

9. The folding bench of claim 1 where said second surface has a securing mechanism to secure a work surface thereto when said second surface is in said extended surface position and to secure said second surface to said first surface when said second surface is in said retracted surface position.

10. The folding bench of claim 1 where said support members, on an end spaced from said first surface, are formed with cutouts to provide a grip for carrying said folding bench.

11. The folding bench of claim 10 and further comprising protective caps on said support members on said end spaced from said first surface.

12. The folding bench of claim 1 where said second surface has brackets for securing a work surface.

13. The folding bench of claim 1 where said first surface has a storage compartment to store work materials, with said storage compartment exposed for inserting or removing said work materials when said second surface is in said extended surface position and with said storage compartment covered and closed when said second surface is in said retracted surface position.

14. The folding bench of claim 1 where said support members are secured in said second retracted support position with a fourth mechanism.

15. A folding bench in accordance with claim 1 wherein said first surface and said support members are each characterized by length and width with the length of each of said support members being of the order of one half the length of said first surface and the width of each of said support members being substantially equal to the width of said first surface and each of said support members, on an end spaced from said first surface, are formed with cutouts to provide a grip for carrying said folding bench.

16. A folding bench in accordance with claim 1 wherein said first mechanism comprises a hinge supporting said second surface in contiguous relationship with said first surface and allowing said second surface to pivot substantially 180° with respect to said first surface.

17. A folding bench comprising, a first surface having first surface support girders;

first and second support members selectively positionable in a first extended support position generally perpendicular to said first surface and in a second retracted support position generally parallel and adjacent to said first surface;

a second surface selectively positionable in a first extended surface position forming a generally obtuse angle relative to said first surface and in a second retracted surface position generally parallel and adjacent to said first surface;

said second surface connected to said first surface with a first mechanism and connected to said first support member with a second mechanism; and a third mechanism arranged to stabilize said support members in said first extended support position and allow said support members to assume said second retracted support position, where said third mechanism comprises a knurled screw, a cam, securing screws, support member stabilizing rods pivotally connected to said support member, and a channel member formed with openings accommodating said support member stabilizing rods.

18. A folding bench comprising, a first surface having first surface support girders;

first and second support members selectively positionable in a first extended support position generally perpendicular to said first surface and in a second retracted support position generally parallel and adjacent to said first surface;

a second surface selectively positionable in a first extended surface position forming a generally obtuse angle relative to said first surface and in a second retracted surface position generally parallel and adjacent to said first surface;

said second surface connected to said first surface with a first mechanism and connected to said first support member with a second mechanism; and a third mechanism arranged to stabilize said support members in said first extended support position and allow said support members to assume said second retracted support position, where said support members are secured in said second retracted support position with a fourth mechanism, where at least one of said first support girders is formed with openings and said fourth mechanism comprises:

first and second hooks attached to said first and second support members respectively;

a locking unit attached to one of said first surface support girders with first and second pins having first and second springs respectively therebetween;

said first and second pins passing freely through said openings in said at least one of said first surface support girders;

wherein said first and second support members are secured in said second retracted position by depressing said lock unit, allowing said first and second support members to assume their respective generally parallel positions, and releasing said locking unit so that said first and second springs return said locking unit to bias said first and second hooks.

* * * * *